US007940953B2

(12) United States Patent
Regl et al.

(10) Patent No.: US 7,940,953 B2
(45) Date of Patent: May 10, 2011

(54) MAGNETIC MEMBRANE SUSPENSION

(75) Inventors: Hans-Juergen Regl, Regensburg (DE); Gerhard Pfaffinger, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 989 days.

(21) Appl. No.: 11/766,184

(22) Filed: Jun. 21, 2007

(65) Prior Publication Data

US 2008/0025550 A1 Jan. 31, 2008

(30) Foreign Application Priority Data

Jun. 21, 2006 (EP) ..... 06012696

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 1/02* | (2006.01) |
| *H04R 1/20* | (2006.01) |

(52) U.S. Cl. ..... 381/399; 381/338; 381/408

(58) Field of Classification Search ..... 381/338, 381/399, 408

See application file for complete search history.

(56) References Cited

U.S. PATENT DOCUMENTS

| | | | |
|---|---|---|---|
| 3,674,946 | A | 7/1972 | Winey |
| 3,832,499 | A | 8/1974 | Heil |
| 3,873,784 | A | 3/1975 | Doschek |
| 3,939,312 | A | 2/1976 | McKay |
| 4,484,037 | A | 11/1984 | Nieuwendijk |
| 4,924,504 | A | 5/1990 | Burton |
| 6,008,714 | A | 12/1999 | Okuda et al. |
| 2001/0048256 | A1 | 12/2001 | Miyazaki et al. |
| 2004/0170269 | A1 | 9/2004 | Madoch et al. |
| 2005/0175208 | A1 | 8/2005 | Shaw et al. |

FOREIGN PATENT DOCUMENTS

| | | | |
|---|---|---|---|
| DE | 1 226 647 | | 10/1966 |
| DE | 2 259 815 | | 6/1973 |
| DE | 37 40 918 | | 6/1988 |
| FR | 2162380 | | 11/1972 |
| GB | 2147768 | | 5/1985 |
| JP | 55 001737 | | 1/1980 |
| JP | 55 068798 | | 5/1980 |
| JP | 55068798 | A * | 5/1980 |
| JP | 55 147899 | | 11/1980 |
| JP | 57054499 | | 3/1982 |
| JP | 58119296 | | 7/1983 |
| JP | 03 262300 | | 11/1991 |

* cited by examiner

*Primary Examiner* — Curtis Kuntz
*Assistant Examiner* — Matthew Eason
(74) *Attorney, Agent, or Firm* — O'Shea Getz P.C.

(57) ABSTRACT

An electro-acoustic transducer has a membrane comprises a folded or curved sheet of film material. A frame supports the membrane in at least an upper end thereof. A resilient suspension connects the upper ends of the membrane to the frame. A driver system is attached to the frame and the membrane for moving the membrane dependent on an electrical input signal. At least one ferromagnetic element is arranged in the membrane or on one of the surfaces of the membrane at its lower end. At least one magnet provides a magnetic field, the magnet being attached to the frame in a position adjacent the lower end of the membrane. The ferromagnetic element is pulled down by a magnetic force between the element and the magnet establishing a gap therebetween such that tensioning of the membrane is achieved by the magnetic force.

19 Claims, 4 Drawing Sheets

MAGNETIC MEMBRANE SUSPENSION

CLAIM OF PRIORITY

This patent application claims priority to European Patent Application serial number 06 012 696.8 filed on Jun. 21, 2006.

FIELD OF THE INVENTION

The present invention relates to membranes for electro-acoustic transducers, and in particular to a magnetic suspension of such membrane.

RELATED ART

Conventional planar electro-acoustic transducers have a membrane for producing sound, the membrane being clamped into a frame. An electrically conductive structure is applied to one surface of the membrane and is connected to an AC voltage source for receiving electrical power therefrom. The vibration of the membrane is induced by current through the electrically conductive structure together with magnetic fields in the vicinity of the electrically conductive structure. The magnetic fields are generated by a large number of magnets arranged in the frame such that they have an opposing relationship with the electrically conductive structure on either side of the membrane. For clamping the membrane, usually mechanical suspensions made from rubber, fabric or the like are used.

Such mechanical suspensions suffer from large manufacturing-dependent tolerances and aging-dependent long-term changes which have a strong impact on the acoustical performance of the transducer.

An object of the present invention is to provide an arrangement for achieving the desired mechanical tension in membranes of electro-acoustic transducers, the arrangement being able to compensate not only for manufacturing-dependent tolerances but also for aging-dependent long-term changes and different operating situations of electro-acoustic transducers to ensure that the membrane is uniformly mechanically tensioned, and which therefore does not have the disadvantages mentioned above.

SUMMARY OF THE INVENTION

An electro-acoustic transducer includes a membrane comprising a folded or curved sheet of film material. The membrane includes an upper end, a lower end, an inner surface, and an outer surface. The transducer also includes a frame for supporting the membrane in at least the upper end of the membrane, and a resilient suspension connecting the upper end of the membrane to the frame. A driver system is attached to the frame and the membrane for moving the membrane dependent on an electrical input signal. At least one ferromagnetic element is arranged in the membrane or on one of the surfaces of the membrane at its lower end. At least one magnet provides a magnetic field. The magnet is attached to the frame in a position adjacent to the lower end of the membrane, where the at least one ferromagnetic element is pulled down by a magnetic force between the at least one ferromagnetic element and the magnet establishing a gap between the magnet and the at least one ferromagnetic element such that tensioning of the membrane is effected by the magnetic force.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Common electro-acoustic transducers exhibit component tolerances in view of a desired exact fixing and alignment of the V-shaped membrane resulting from the respective manufacturing process. Known arrangements for mounting or clamping the membrane, in particular arrangements made from flexible materials such as foam, rubber or soft beads, also tend to change (for example, as a result of aging and wear processes, or because of different operating states, such as temperature fluctuations) the mechanical tension on the membrane. As a result, the acoustical characteristics of the transducer may change in an undesirable manner. Particularly, a V-shaped membrane as described above may be subject to fluctuations of the mechanical tension to an even larger extent. However, the V-shape of the membrane reduces the size of the acoustic aperture, with the desirable effect that the directional characteristic is broadened, and thus improved.

Figure 1:
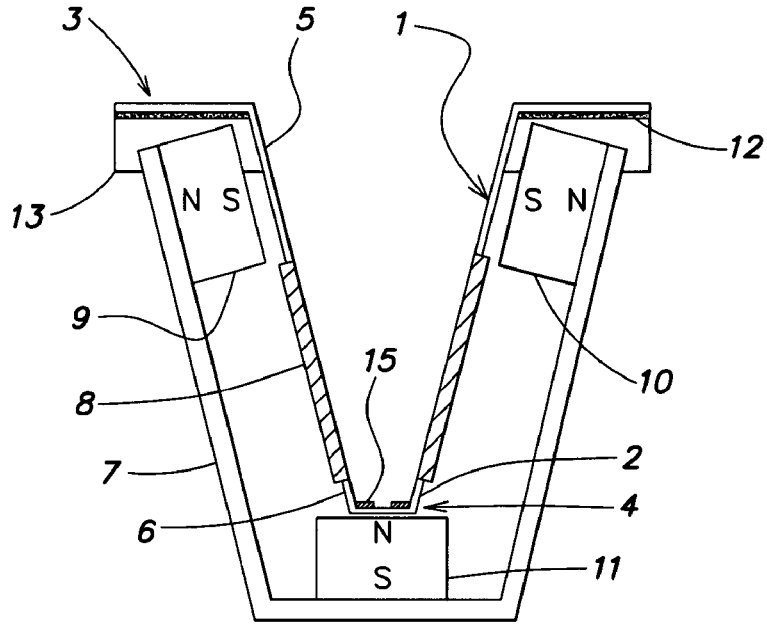
FIG. 1 is a schematic drawing of an electro-acoustic transducer producing magnetically a desired mechanical tension in the membrane of the transducer.

FIG. 1 illustrates an electro-acoustic transducer having a generally V-shaped membrane 1 that includes a folded or curved sheet 2 of film material comprising polyethylene and/or polyethylene-naphthalate and/or polymid. The membrane 1 has two upper ends 3, a lower end 4, an inner surface 5, and an outer surface 6. The membrane 1 is supported in at least the upper two ends 3 by a rigid frame 7 surrounding the membrane 1 on its outer surface 6. On the inner surface 5 and/or the outer surface 6 of the membrane 1, a structured conductive layer 8 is arranged representing a voice coil like circuit. The structured conductive layers 8 are connected to electrical terminals (not shown) to receive electrical input signals (not shown). Permanent magnets 9, 10, 11 are attached to the frame 7 in positions adjacent to the upper two ends 3 and the lower end 4 of the membrane 1.

The conductive layers 8 are arranged on the membrane 1 substantially in positions not opposite to the magnets 9, 10, 11. The permanent magnets 9, 10, 11 are arranged in a position between the frame 7 and the outer surface 6 of the membrane 1. Further, the permanent magnets 9, 10, 11 are preferably neodymium magnets and are arranged such that they generate opposing magnetic fields. For example, the magnets 9, 10 at the upper ends 3 have their South poles S facing the membrane 1 while the magnet 11 at the lower end 4 of the membrane 1 has its North pole N facing the membrane 1.

The membrane 1 is fixed at the upper ends 3 by adhesive 12 to a front element 13 having a substantially rectangular shape, where the front element 13 is attached to the frame 7 for providing sufficient locating surface for the membrane 1. Beside the shape of the front element 13 shown in FIG. 1, other forms are applicable as in particular a shape with an external radius or holding clamps for clamping the membrane 1 to the front element 13 at the two upper ends 3. Further, the membrane 1 is tensioned between the two upper ends 3 and the lower end 4.

Figure 6A:
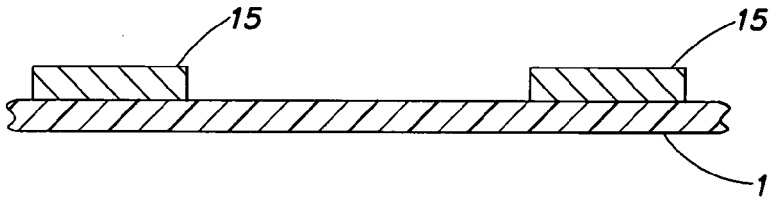
FIGS. 6A-6D, are cross-sectional views of various multilayer membranes with ferromagnetic elements on their outer faces and/or in their interior.
Figure 6B:
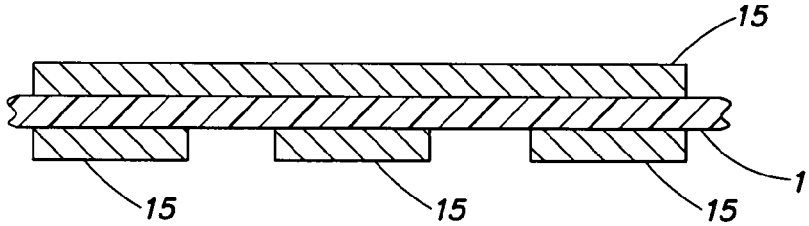
Figure 6C:
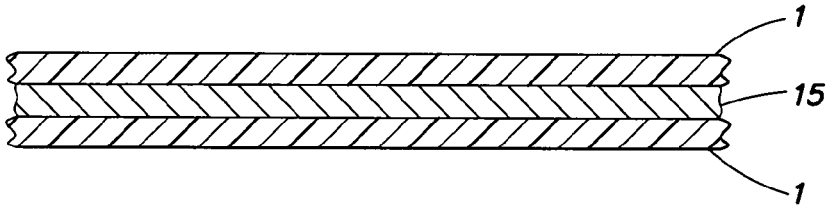

The membrane 1 illustrated in FIG. 1 may be a multi-layer membrane having two outer non-magnetic layers and an inner ferromagnetic layer 15 (see FIG. 6*c*). The ferromagnetic layer 15 interacts with the magnet 11 providing a mechanical tension to the membrane 1. The ferromagnetic layer may be made from a multitude of magnetic particles.

Figure 2:
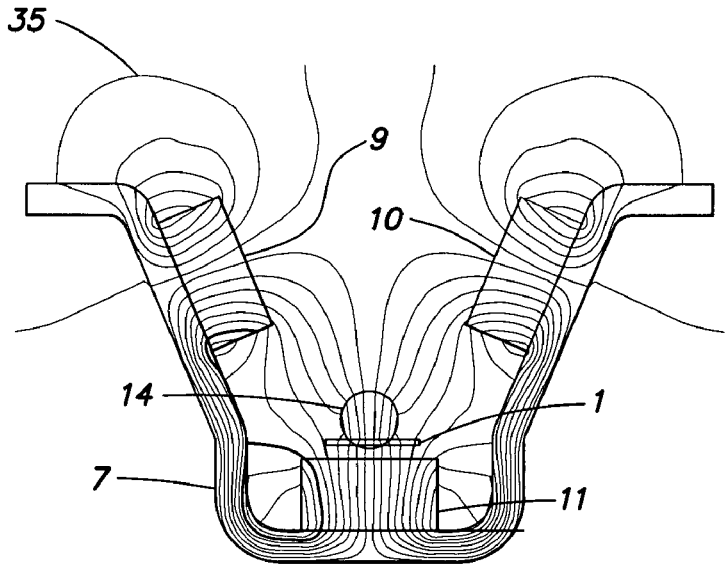
FIG. 2 is a cross-sectional view of another embodiment of an electro-acoustic transducer having a rod-like ferro-magnetic element for focusing the usable magnetic flux density and producing the desired mechanical tension.

FIG. 2 is a cross sectional view of an alternative embodiment of an electro-dynamic acoustic transducer having a soft-magnetic element 14 for focusing magnetic flux. The soft-magnetic element 14 is ferromagnetic, in particular a steel rod or any other soft-magnet adapted to focus magnetic flux as shown by magnetic flux lines 35 in FIG. 2. The rod 14 is arranged centrally with respect to the permanent magnet 11 positioned at the lower end of the V-shaped membrane 1. The magnetic field produced by the permanent magnets 9, 10 and 11 results in the round rod 14 on the one hand being centered above the permanent magnet 11, and being fixed to it by the magnetic attraction force.

The rod 14 provided for focusing the magnetic flux is also used for holding the membrane 1 of an electro-acoustic transducer such that it is tensioned. In FIG. 2, the V-shaped membrane 1 (only partly shown for the sake of simplicity) of the transducer is designed such that the deepest point of the V-shaped membrane is at a specific distance, for example 0.3 to 2 mm, from the lower permanent magnet 11 in the rest state.

The round rod 14 is now no longer placed directly on the permanent magnet 11, but in a groove, that is, at the lowest point of the V-shaped membrane 1. The permanent magnet 11 exerts a corresponding attraction force on the round rod 14, as a result of which the V-shaped membrane 1 is held in a mechanically tensioned state. In this case, the strength of the attraction force which results from the arrangement of the round rod 14 and the magnet 11 and thus the mechanical tension in the V-shaped membrane 1 depends on the magnetic strength of the permanent magnet 11, the distance of the magnet 11 from the lowest point of the V-shaped membrane 1 and thus of the round rod 14 from the permanent magnet 11, and on the dimensions of the round rod 14 itself. Experiments have shown that the diameter of the round rod 14 demonstrates relatively good results when corresponding at most to 75% of the width of the permanent magnet 11 to ensure the desired characteristics.

Figure 3:
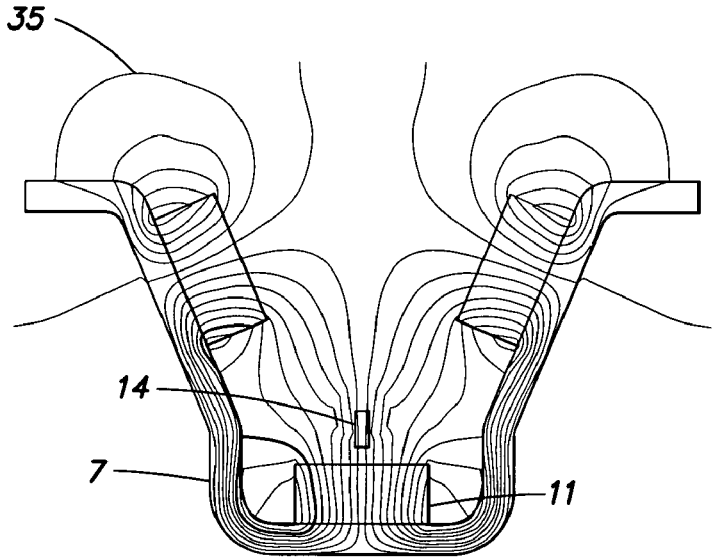
FIG. 3 is a schematic drawing of yet another embodiment of an electro-acoustic transducer having an alternative ferromagnetic element for focusing the usable magnetic flux density and producing the desired mechanical tension.

FIG. 3 illustrates another embodiment of a ferromagnetic element, in this case a bar-like vertically extending rod 14 located in the groove of the V-shaped membrane 1 (not shown). As can be seen from FIG. 3, the bar-like rod 14 is not in direct contact with the surface of the permanent magnet 11, but is located centrally in the groove at the lower end 4 of the membrane 1, aligned centrally by the magnetic field of the permanent magnets 9, 10 and 11. The short separation from the bar-like rod 14 (for example 0.2 to 3 mm) which is governed by the distance between the lower end 4 of the membrane 1 and the permanent magnet 11, in this case also results in the desired focusing of the magnetic flux density of the magnetic field produced by the permanent magnets 9, 10 and 11.

Figure 4:
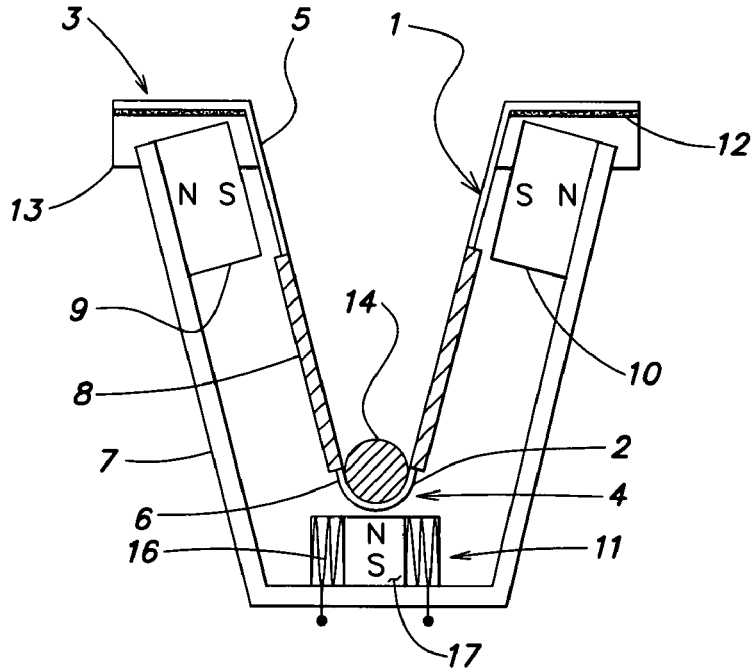
FIG. 4 is a schematic drawing of still another embodiment of an electro-acoustic transducer with a rod-shaped ferromagnetic element for producing the desired mechanical tension and a membrane adapted thereto.

In the embodiment of FIG. 4 which is similar to that of FIG. 2, the groove of the V-shaped membrane 1 is designed to be semicircular with an internal diameter of, for example, the semicircular curvature which corresponds to the external diameter of the round rod 14. In this way, the round rod 14 is positioned at the geometric center of the V-shaped membrane 1, which in turn aligns the geometric center of the V-shaped groove, by the corresponding magnetic force effect on the round rod 14, in the center of the magnetic field formed by the permanent magnets 9, 10 and 11 and over a wide range independently of any tolerances or discrepancies as described above in the positioning and alignment of the membrane 1, irrespective of whether these result from manufacture, or from different operating conditions, such as temperature fluctuations or are caused by long-term changes, such as aging of suspension materials. The mechanical tension exerted on the membrane 1 via the attraction of the round rod 14 is accordingly largely independent of the tolerances as described above and changes in the positioning parameters of the membrane 1 over the course of operation of the electro-acoustic transducer.

The principle of operation of the described arrangement can also be used for a large number of further embodiments of membranes for dynamic electro-acoustic transducers. For example, the membrane need not have a V-shaped configuration, and the ferromagnetic element for production of the mechanical tension and for centering of the membrane need not be arranged in the form of an element separate from and independent of the membrane.

As illustrated in the embodiment of FIG. 1, planar or substantially planar ferromagnetic elements may be fitted to the membrane of electro-acoustic transducers, for example, by adhesive bonding, printing or vapor deposition, or by similar suitable processes. In this arrangement, an attraction force is exerted on the ferromagnetic elements of the membrane by a magnetic field produced by a permanent magnet of the respective dynamic electro-acoustic transducer, and a mechanical tension is thus exerted on the membrane of the transducer. With a suitable magnetic field and suitable arrangement of the ferromagnetic elements on and/or in the membrane of the electro-acoustic transducer, desired positioning and centering of the membrane in the magnetic field of the permanent magnets of the respective dynamic electro-acoustic transducer can be achieved.

Figure 5:
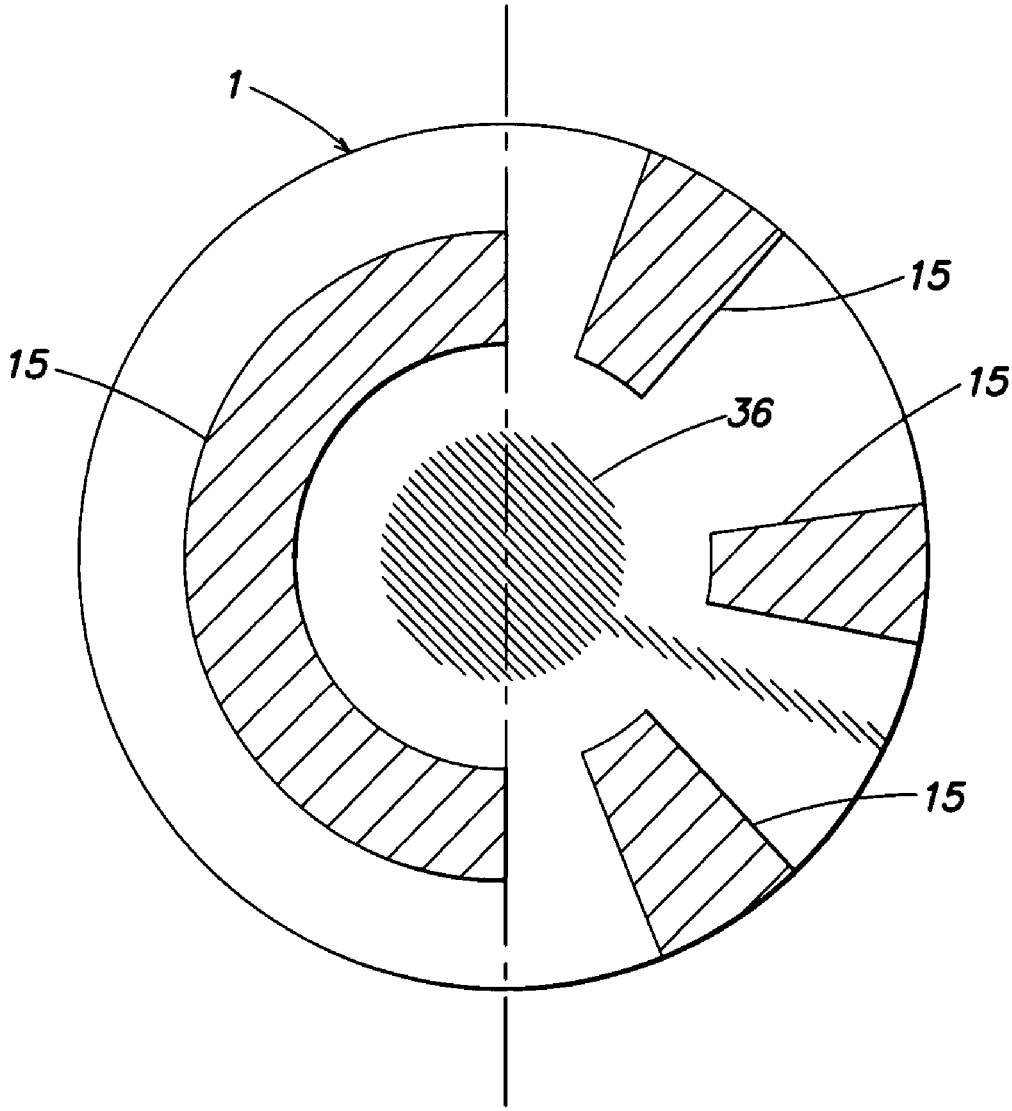
FIG. 5 is a plan view of an arrangement of ferromagnetic elements fitted to a round and substantially planar membrane.

Examples of planar ferromagnetic elements 15 fitted to a membrane 1 of an electro-acoustic transducer are illustrated in FIG. 5, which is a plan view of such a membrane 1. The membrane 1 is substantially planar and has a round shape. For ease of illustration the illustration does not show any cups or electrically conductive structures, which may be applicable depending on the configuration of the membranes of real transducers. The left-hand half of the illustration in FIG. 5 illustrates an annular ferromagnetic element 15 fitted concentrically on the surface of the membrane 1. The right-hand half of FIG. 5 in turn illustrates ferromagnetic elements 15 in the form of segments.

The ferromagnetic elements 15 may be in any desired configuration and arrangement that ensures appropriate positioning of the ferromagnetic elements 15 with respect to the magnet that produces the magnetic field for effecting the attraction force on these ferromagnetic elements 15. The ferromagnetic elements 15 may be arranged in or on a membrane and may also be used as and/or together with other elements of such membranes, such as, e.g., electrically conductive structures (see below). Further, the attraction force on the ferromagnetic elements for effecting the mechanical membrane tension may alternatively or additionally be generated by additional magnets arranged independently of those permanent magnets basically used for sound reproduction. Preferably, these additional magnets are designed in terms of their arrangement and/or magnetic field force such that they do not undesirably change the magnetic field of the permanent magnets that are used for sound reproduction, or possibly even have only a positive effect on it.

Beside the ferromagnetic elements 15, an electrical contact pad 36 may be in contact with the conductive rod 14 thereby allowing electrical current to flow to the conductive structures 8 on the membrane 1 via the rod 14. The conductive structures (not illustrated in detail in FIG. 5) may form windings or be connected to coils interacting with the magnets 11 when current is applied.

An arrangement according to an aspect of the present invention can be used not only with dynamic electro-acoustic transducers which, by their principle of operation, already have permanent magnets, but also with other electro-acoustic transducers, such as, e.g., piezo transducers, dielectric transducers or electret transducers, in which the magnets required for the magnetic attraction force on the ferromagnetic elements on and/or in the membranes are fitted at suitable positions in these electro-acoustic transducers.

The attraction force on the membrane having ferromagnetic elements may also be produced by controllable magnetic fields, e.g., by electro magnets having a coil 16 (as illustrated in FIG. 4) and, depending on the application, a soft-magnetic core 17 (as illustrated in FIG. 4). The magnetic field strength is controllable by varying the current through the coil. Accordingly, the mechanical tension of the membranes in the electro-acoustic transducers may be varied during operation of the transducers, thus allowing, for example, control of the directional characteristic and the frequency response of the electro-acoustic emission in a desired manner during operation.

In all cases in which ferromagnetic elements are fitted on and/or into the membrane of an electro-acoustic transducer, these ferromagnetic elements can also be used to influence the stiffness of the respective membrane by a suitable geometric arrangement of the ferromagnetic elements on and/or in the membrane of the transducer, in a desired manner. The ferromagnetic elements may be fitted to the membrane on the lower face or on the upper face of the membrane, or on both sides. In the case where the ferromagnetic elements are fitted both to the upper face and the lower face of the membrane, the geometric arrangement on both faces may differ from each other.

With any desired combinations of the fitting of the ferromagnetic elements on one or both outer surfaces of the membrane, the ferromagnetic elements optionally may also be fitted in the membrane, to achieve the desired mechanical membrane tension by the attraction force of the existing permanent magnets, additional permanent magnets or additional arrangements, whose magnetic force on these ferromagnetic elements is controllable.

FIGS. 6A-6D illustrate four embodiments for fitting and/or inserting of the ferromagnetic elements onto or into the membranes of electro-acoustic transducers. FIGS. 6A-6D are cross sectional views of area elements of the membranes which, in the present example, are substantially planar. FIG. 6A illustrates a membrane 1 on whose upper face the ferromagnetic elements 15 are fitted. These ferromagnetic elements 15 may be continuous in the form of an annular element, or else may be in the form of an arrangement comprising a plurality of individual ferromagnetic elements (in this context, see FIG. 5).

Figure 6D:
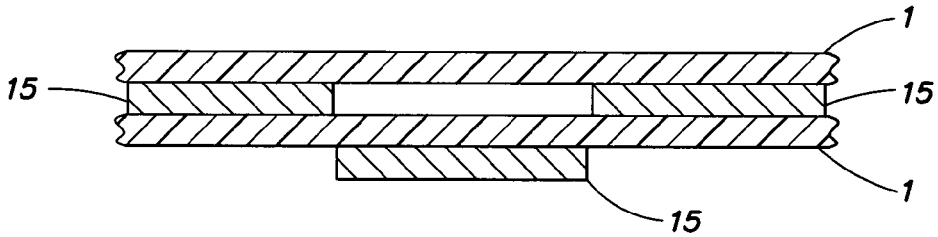

FIG. 6B illustrates a membrane of an electro-acoustic transducer, where the membrane 1 has the ferromagnetic elements 15 disposed not only on the upper face but also on the lower face. These ferromagnetic elements 15 are, in the present case, flat or in the form of disks (FIG. 6B upper face). FIG. 6C illustrates a membrane which has at least two membrane layers 1 enclosing a ferromagnetic element 15 which is not located on one of the surfaces of the membrane, but within the membrane. In this case, the ferromagnetic elements 15 may once again be flat, in the form of a disk or annular, or in the form of an arrangement comprising a plurality of individual ferromagnetic sub-elements of any desired configuration. FIG. 6D illustrates a membrane 1 having the ferromagnetic elements 15 between two layers of a multi-layer membrane 1 as well as on the lower surface of the membrane 1.

All the arrangements illustrated above as well as all other arrangements within the scope of the present invention may exert a controllable attraction force on the membranes of electro-acoustic transducers by a controllable magnetic field strength to vary the mechanical membrane tension, the stiffness of the membrane and thus, for example, the directional characteristic and the frequency response of the electro-acoustic emission during operation of the electro-acoustic transducer.

The advantageous effect of the invention results from the attraction force exerted by permanent magnets on ferromagnetic elements in and/or on the membrane of an electro-acoustic transducer, as a result of which the membrane is held subject to a defined mechanical tension, and the membrane in its totality is aligned within the magnetic field. Arrangements according to the invention compensate for or greatly reduce manufacturing-dependent tolerances of the suspension or mounting of the membranes which can oscillate in an electro-acoustic transducer, in terms of positioning and mechanical tension on the membranes. Arrangements according to the invention compensate for or greatly reduce tolerances which are caused by the process of assembly of an electro-acoustic transducer, in terms of the positioning and the mechanical tension on the membranes of an electro-acoustic transducer.

Techniques of the present invention compensate for or greatly reduce the changes caused by different operating states such as temperature fluctuations or mechanical tensions on the transducer housing, with respect to the alignment and the mechanical tension on the membrane of an electro-acoustic transducer. When the changes result from long-term changes, for example from aging and/or fatigue of the materials that are used, e.g., plastics, paper etc., in the parameters which are relevant for the mechanical tension and the alignment of the membrane can be compensated for or greatly reduced by the arrangements according to the invention. A further advantage is that the membrane is automatically centered in the magnetic field of the permanent magnets of the transducer. Even further advantages can be obtained if the magnetic field strength can be varied during operation of the electro-acoustic transducer.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. An electro-acoustic transducer, comprising:

a membrane that comprises a sheet of film material, the membrane having two upper ends that extend from a lower end separated by an angle less than ninety degrees, an inner surface, and an outer surface;

a frame that supports the membrane in at least the upper ends of the membrane;

a voice coil comprising a structured conductive layer arranged on at least one of the inner or outer surfaces of the membrane, that moves the membrane dependent on an electrical input signal;

at least one ferromagnetic element arranged in the membrane or on one of the inner or outer surfaces of the membrane at the lower end of the membrane;

a first magnet attached to the frame in a position adjacent to the lower end of the membrane; and a second magnet attached to the frame adjacent to a first of the two upper ends of the membrane, and a third magnet attached to the frame adjacent to a second of the two upper ends of the membrane;

where the at least one ferromagnetic element is pulled down by a magnetic force between the at least one ferromagnetic element and the first magnet establishing a gap between the first magnet and the at least one ferromagnetic element such that tensioning of the membrane is effected by the magnetic force.

2. The electro-acoustic transducer of claim 1, where the ferromagnetic element of the membrane has a flat or disk-like shape.

3. The electro-acoustic transducer of claim 1, where the ferromagnetic element of the membrane comprises a ferromagnetic round rod.

4. The electro-acoustic transducer of claim 3, where the rod is arranged in a groove in the upper surface and at the lower end of the membrane, where the groove has a semicircular shape such that it holds the rod in an interlocking manner.

5. The electro-acoustic transducer of claim 1, further comprising at least two ferromagnetic elements, where the ferromagnetic elements are arranged on one or both surfaces of the membrane.

6. The electro-acoustic transducer of claim 1, where the membrane comprises a multilayer membrane, where the at least one ferromagnetic element is inserted between the layers of the multilayer membrane.

7. The electro-acoustic transducer of claim 6, where the at least one ferromagnetic element comprises a ferromagnetic layer.

8. The electro-acoustic transducer of claim 6, where the at least one ferromagnetic element comprises a plurality of ferromagnetic particles arranged between the layers of the multilayer membrane.

9. The electro-acoustic transducer of claim 1, where the at least one ferromagnetic element is arranged on and/or in the membrane such that the stiffness of the membrane is increased at the same time.

10. The electro-acoustic transducer of claim 1, where the first magnet comprises a permanent magnet.

11. The electro-acoustic transducer of claim 1, where the first magnet comprises an electro-magnet having at least one winding supplied with a direct current.

12. The electro-acoustic transducer of claim 11, where a magnitude of the direct current is variable such that the tension of the membrane is variable depending on the magnitude of the direct current.

13. The electro-acoustic transducer of claim 1, where the conductive layer is arranged on the membrane substantially in positions non-adjacent to the magnets.

14. The electro-acoustic transducer of claim 13, where the structured conductive layer is arranged between the second and third magnets and the first magnet.

15. The electro-acoustic transducer of claim 1, where the frame comprises an external radius supporting the membrane at its two upper ends.

16. The electro-acoustic transducer of claim 1, where at least two additional ferromagnetic elements are arranged adjacent to the second and third magnets, respectively, for providing a magnetic force centering the membrane.

17. The electro-acoustic transducer of claim 1, further comprising a sound wave guiding element arranged in a position adjacent to the inner surface of the membrane.

18. The electro-acoustic transducer of claim 1, further comprising conductive structures and at least one electrical contact pad connected to the conductive structures and arranged on the membrane such that the pad contacts the at least one ferromagnetic element, where the at least one ferromagnetic element is electrically conductive thereby supplying electrical current to the conductive structures.

19. An electro-acoustic transducer, comprising:

a frame;

a membrane attached to the frame and having two upper ends that extend from a lower end separated by an angle less than ninety degrees, an inner surface, and an outer surface;

a voice coil comprising a structured conductive layer arranged on at least one of the inner or outer surfaces of the membrane, that moves the membrane dependent on an electrical input signal;

at least one ferromagnetic element arranged at a first location in the membrane or on one of the inner or outer surfaces of the membrane at the first location;

a first magnet attached to the frame in a position adjacent to the first location of the membrane; and a second magnet attached to the frame adjacent to a first of the two upper ends of the membrane, and a third magnet attached to the frame adjacent to a second of the two upper ends of the membrane;

where the at least one ferromagnetic element is displaced by a magnetic force between the at least one ferromagnetic element and the first magnet such that tensioning of the membrane is effected by the magnetic force.

* * * * *